US008514034B2

(12) United States Patent
Kang

(10) Patent No.: US 8,514,034 B2
(45) Date of Patent: Aug. 20, 2013

(54) RADIO FREQUENCY (RF) MICROWAVE COMPONENTS AND SUBSYSTEMS USING LOADED RIDGE WAVEGUIDE

(75) Inventor: Yoon W. Kang, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 379 days.

(21) Appl. No.: 12/905,792

(22) Filed: Oct. 15, 2010

(65) Prior Publication Data

US 2012/0092091 A1 Apr. 19, 2012

(51) Int. Cl.
*H01P 3/12* (2006.01)
*H01P 3/00* (2006.01)

(52) U.S. Cl.
USPC ..... 333/208; 333/211

(58) Field of Classification Search
USPC ..... 333/208, 209, 211, 212
See application file for complete search history.

(56) References Cited

U.S. PATENT DOCUMENTS

| | | | | |
|---|---|---|---|---|
| 3,852,764 | A * | 12/1974 | Smith | 343/778 |
| 4,096,457 | A * | 6/1978 | Snyder | 333/208 |
| 5,528,208 | A | 6/1996 | Kobayashi | |
| 5,724,011 | A * | 3/1998 | McWhirter et al. | 333/157 |
| 7,411,472 | B1 * | 8/2008 | West et al. | 333/125 |

FOREIGN PATENT DOCUMENTS

EP 1 432 062 A1 6/2004

OTHER PUBLICATIONS

G. Magerl, "Ridged Waveguides with Inhomogeneous Dielectric-Slab Loading," IEEE Transactions on Microwave Theory and Techniques, vol. MTT-26, No. 6, Jun. 1978, pp. 413-416.
S. Martynyuk et al., "Widebank Transition From Coaxial To Double Ridged Waveguide," 2005 5th International Conference on Antenna Theory and Techniques, May 24-27, pp. 287-288.
K. Ng et al., "Unified Solution of Various Dielectric-Loaded Ridge Waveguides with a Mixed Spectral-Domain Method," 8099 IEEE Transactions on Microwave Theory and Techniques, vol. 37, No. 12, Dec. 1, 1989, pp. 2080-2085.
S. Xianye, "Solution of quasi-TE10 Mode in ferrite Slab Loaded Ridged/Grooved Waveguide," Nanjing Research Institute of Electronic Technology, Nanjing, XP-002667086, Aug. 18, 1998 pp. 873-876.

* cited by examiner

*Primary Examiner* — Dean O Takaoka
(74) *Attorney, Agent, or Firm* — Pauley Petersen & Erickson

(57) ABSTRACT

A waveguide having a non-conductive material with a high permeability ($\mu$, $\mu_r$ for relative permeability) and/or a high permittivity ($\in$, $\in_r$ for relative permittivity) positioned within a housing. When compared to a hollow waveguide, the waveguide of this invention, reduces waveguide dimensions by $$\propto \sqrt{\frac{1}{\mu_r * \varepsilon_r}}.$$

The waveguide of this invention further includes ridges which further reduce the size and increases the usable frequency bandwidth.

17 Claims, 8 Drawing Sheets

RADIO FREQUENCY (RF) MICROWAVE COMPONENTS AND SUBSYSTEMS USING LOADED RIDGE WAVEGUIDE

GOVERNMENT RIGHTS

This invention was made with government support under Contract No. DE-AC05-00OR22725 awarded by the U.S. Department of Energy. The government has certain rights in the invention.

FIELD OF THE INVENTION

This invention is directed to a ridge waveguide having a dispersive filling material with a high permeability ($\mu$, $\mu_r$ for relative permeability) and/or a high permittivity ($\in$, $\in_r$ for relative permittivity) material to reduce waveguide dimensions.

BACKGROUND OF THE INVENTION

A waveguide is a structure that guides waves, such as electromagnetic waves or sound waves. Commonly known waveguides include hollow metal tubes which allow high frequency radio waves to "bounce" off walls of the hollow metal tubes to propagate down the waveguide. Commonly known waveguides have cross sections in rectangular, circular, or elliptical shapes. These common waveguides generally have a limited bandwidth, usually around 30% of a center of an operating frequency range.

Electromagnetic and sound waves in open space propagate in all directions as a spherical wave. When propagating in open space, the waves lose power proportional to the square of the distance from a source. When propagating in a waveguide, a wave has very little power loss, generally a wall conductor loss and a dispersive medium loss which are generally negligible. Ideally, the dimensions of a waveguide are selected so that, for a particular frequency(s), the wave is not cutoff and higher-order modes are not excited to minimize power loss.

One disadvantage of hollow metallic waveguides is the size of the waveguide. In general, the width of the waveguide needs to be of the same order of magnitude as the free-space wavelength of the guided wave. Thus, waveguides for radio and microwave transmission can be relatively large and unwieldy, especially when designed for frequencies in several hundreds or thousands of MHz range.

Accordingly, there is a need for an improved waveguide having smaller dimensions than an equivalent hollow metal waveguide at a particular operating frequency.

SUMMARY OF THE INVENTION

The present invention is directed to radio frequency components that are building blocks of various radio frequency circuits and systems. The components are built with waveguides which include a low loss dispersive material with a high-permeability and/or a high-permittivity. In one embodiment, the dispersive material comprises a dielectric material with a permittivity that is higher than the permittivity of air and permeability that is approximately equal to the permeability of air. The waveguides may further include a ridge for a broad frequency bandwidth and a further reduction in a dimension of the waveguide.

One advantage of the present invention is a reduction in component size in comparison to a similar prior art component for RF frequencies from approximately 100 to 1,000,000 MHz. Additionally, the present invention enables relatively high power capability and easier manufacturing and assembly in comparison to prior art components.

Filling a waveguide with a non-conductive material with a relative permeability greater than one and/or a relative permittivity greater than one can reduce waveguide dimensions over known waveguides by $$\propto \sqrt{\frac{1}{\mu_r * \varepsilon_r}},$$

for the same frequencies of operation. Introducing ridge(s) can further reduce the waveguide dimensions and increase the usable frequency bandwidth.

BRIEF DESCRIPTION OF THE DRAWINGS

These and other objects and features of this invention will be better understood from the following detailed description taken in conjunction with the drawings, wherein.

DESCRIPTION OF PREFERRED EMBODIMENTS

Figure 1:
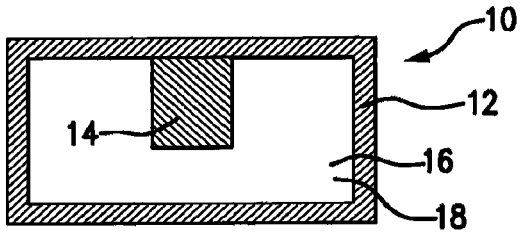
FIG. 1 is a cross-sectional view of a waveguide according to one embodiment of this invention.

Waveguides are generally used in high power RF (radio frequency) or microwave transmission components and systems. FIG. 1 shows a cross-sectional view of a single-ridge waveguide 10 according to one embodiment of this invention. The single-ridge waveguide 10 includes a housing 12 and a ridge 14. In a preferred embodiment, the housing 12 is a metallic material for example, but not limited to, copper.

In a preferred embodiment, a volume 16 of the single-ridge waveguide 10 is filled with a non-conductive filling material 18 having a high permeability ($\mu$, $\mu_r$ for relative permeability) and/or a high permittivity ($\in$, $\in_r$ for relative permittivity). Filling the single-ridge waveguide 10 with the non-conductive material 18 can reduce waveguide dimensions by $$\propto \sqrt{\frac{1}{\mu_r * \varepsilon_r}}.$$

The non-conductive material can comprise, for example, alumina ceramic, Teflon, or any non-conductive material with a relative permeability greater than one and/or a relative permittivity greater than one.

Figure 2:
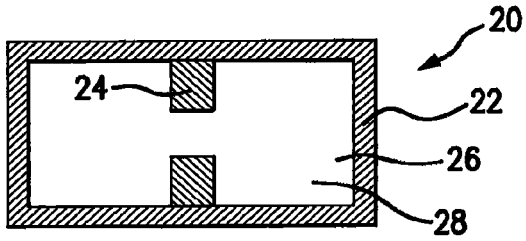
FIG. 2 is a cross-sectional side view of a waveguide according to another embodiment of this invention.

FIG. 2 shows a cross-sectional view of a double-ridge waveguide 20 according to one embodiment of this invention. The double-ridge waveguide 20 includes a housing 22 and a pair of oppositely positioned ridges 24. In a preferred embodiment, a volume 26 of the double-ridge waveguide 10 is filled with a non-conductive material 28 having a high permeability ($\mu$, $\mu_r$ for relative permeability) and/or a high permittivity ($\in$, $\in_r$ for relative permittivity). Filling the double-ridge waveguide 20 with the non-conductive material 28 can reduce waveguide dimensions by $$\propto \sqrt{\frac{1}{\mu_r * \varepsilon_r}}.$$

In FIGS. 1 and 2, the housings 12, 22 are rectangular-shaped with a pair of broad walls and a pair of narrow walls. However, the housing of this invention can be any shape including, but not limited to, a circular shape or an elliptical shape.

In comparison to known waveguides without ridges, the ridges 14, 24 reduce the transverse dimensions of the waveguides 10, 20. The ridges 14, 24 also increase an operational frequency range of the waveguide 10, 20, in comparison to a similar waveguide without ridges. The operational frequency range of the ridged waveguide 10, 20 can be increased by 100% or more depending on ridge dimensions.

Figure 3:
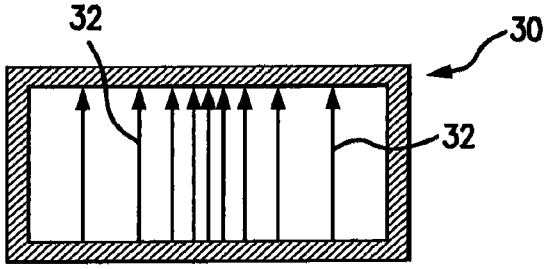
FIG. 3 is a cross-sectional view of a know waveguide showing vectors of an electric field.
Figure 4:
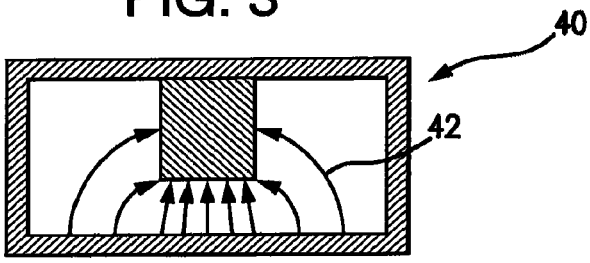
FIG. 4 is the cross-sectional view of the waveguide of FIG. 1 with vectors showing an electric field.
Figure 5:
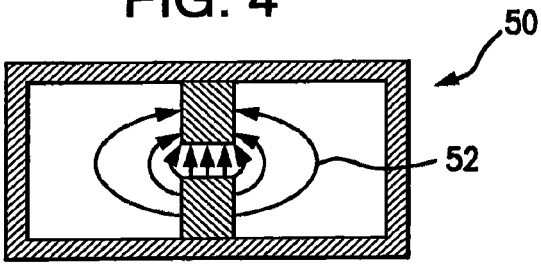
FIG. 5 is the cross-sectional view of the waveguide of FIG. 2 with vectors showing an electric field.

The addition of ridges 14, 20, however, may increase the microwave loss and lower peak power handling capability. FIG. 3 shows electric field (E-field) vectors 32 in a prior art waveguide 30. FIG. 4 shows electric field (E-field) vectors 42 in a single-ridge waveguide 40 and FIG. 5 shows electric field (E-field) vectors 52 in a double-ridge waveguide 50. The density of the electric field lines show the strength of the E-field and can also show that the voltage is integrated along a vector path $V=\int E \cdot dl$. As shown in the figures, the E-field vectors 32, 42, 52 have a sinusoidal strength distribution in a horizontal direction. The highest voltage peaks appear between the two broad walls at the center. A voltage rating and a power rating of both the single-ridge waveguide 40 and the double-ridge waveguide 50 is less than the prior art waveguide 30 due to decreased gap distance at the voltage peak.

Filling the volume 16, 26 of the ridged waveguide 10, 20 completely with the non-conductive material 18, 28, reduces a wavelength by $1/\sqrt{\in_r \mu_r}$ (a ratio of the wavelength in free space (air or a vacuum) to the wavelength in the filling material is $\cong 1/\sqrt{\in_{r\mu r}}$). As a result, dimensions of the waveguide structure can be reduced by a similar amount. For reference, the permittivity of a vacuum is $\in_r=1.0$ and thin air is approximately equal to 1.0. Non-conductive materials can have varying permittivity, for example: Teflon $\in_r=2.1$, glass $\in_r=4$, alumina ceramic $\in_r=10$, water $\in_r=10-90$, and some ceramic materials can have $\in_r$ greater than 10 and even greater than 1,000.

With nonmagnetic dielectric materials, such as plastic or ceramic materials, the relative permeability is $\mu_r=1$. Thus, filing the waveguide with a nonmagnetic material reduces the waveguide dimensions by $=1/\sqrt{\in_r}$. This relationship is more realistic for metallic hollow waveguides with an operating frequency in the hundreds of megahertz (MHz) or higher due to high magnetic loss of most magnetic materials.

Known waveguides and devices are often filled with compressed air or gas, having a $\in_r=1.0$, to increase the power ratings. Some very high power applications, high vacuum (means actually low vacuum), provide a very high voltage rating, however, such waveguides are bulky and generally very expensive. Filling the volume 16, 26 with the non-conductive material 18, 28 also increases a power rating of the waveguide 10, 20, without the high expense of known waveguides.

Using the properties discussed above, multiple radio frequency (RF)/microwave components can be designed. The following components are designed for an example operating frequency of approximately 400 MHz. The components can be scaled to any operating frequency. The components can also be modified for different non-conductive materials with different permeability and different permittivity.

Figure 6A:
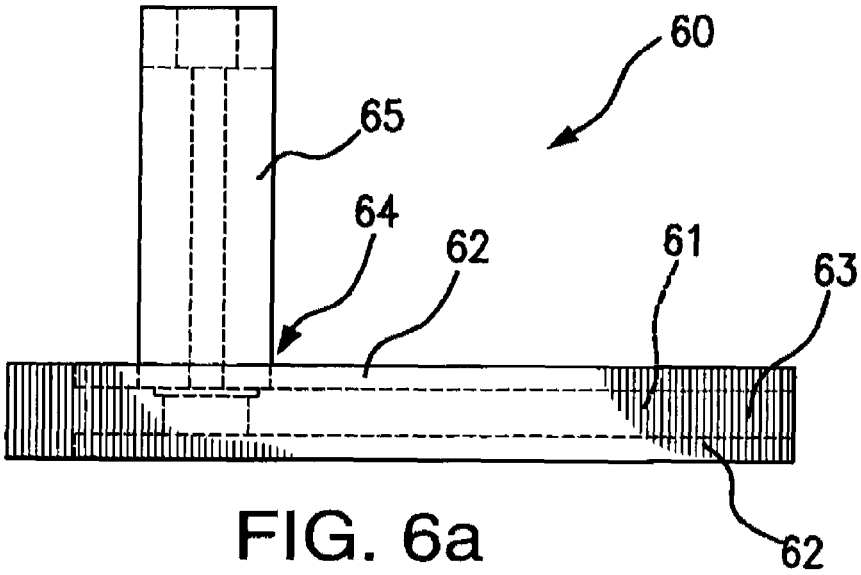
FIG. 6*a* is a side view of a waveguide to coaxial transformer according to one embodiment of this invention.
Figure 6B:
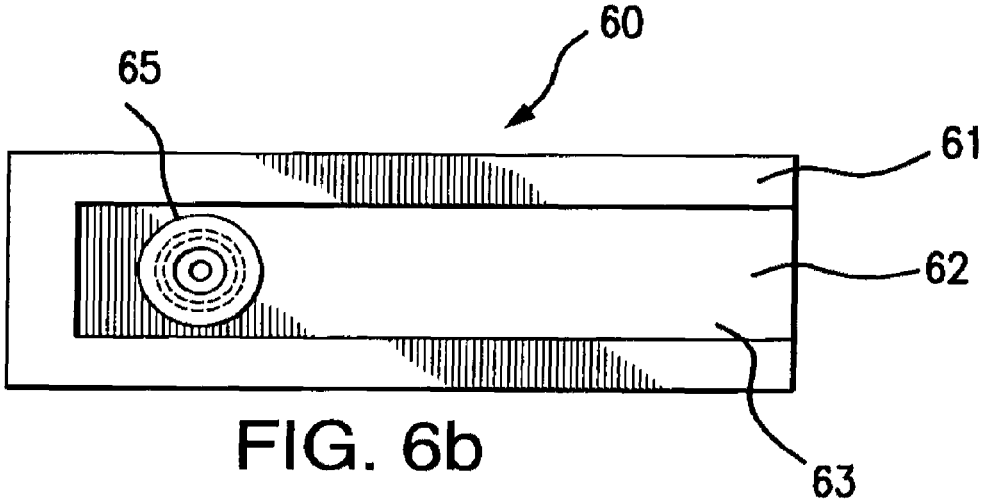
FIG. 6*b* is a top view of the waveguide to coaxial transformer of FIG. 6*a;*
Figure 6C:
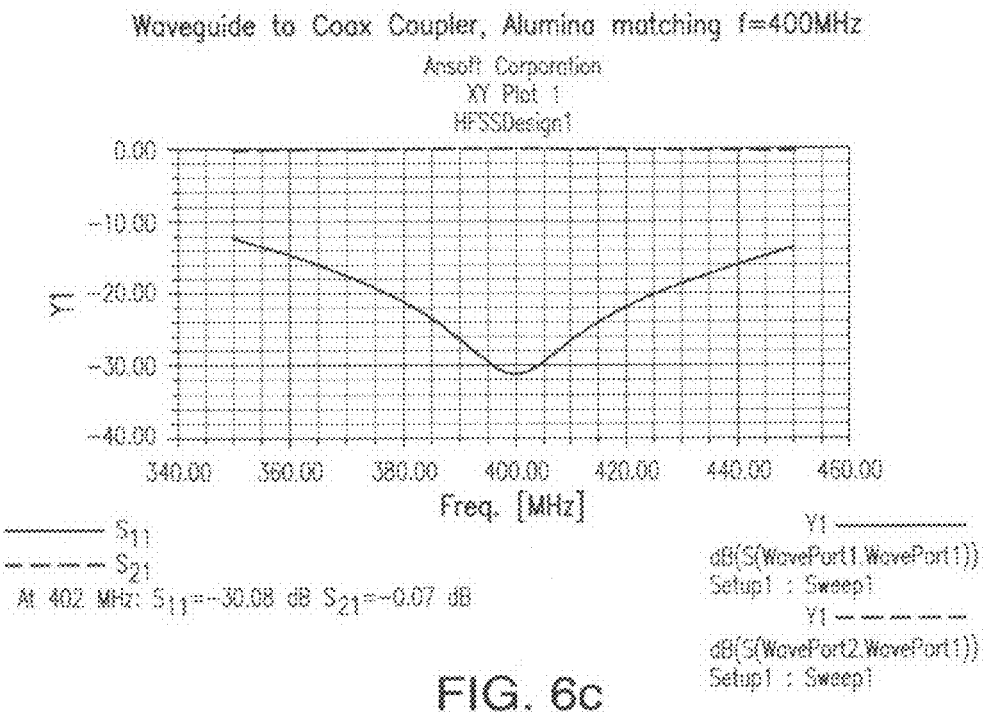
FIG. 6*c* is a computer simulated transmission response of a matching section of the waveguide to coaxial transformer of FIG. 6*a;*
Figure 6D:
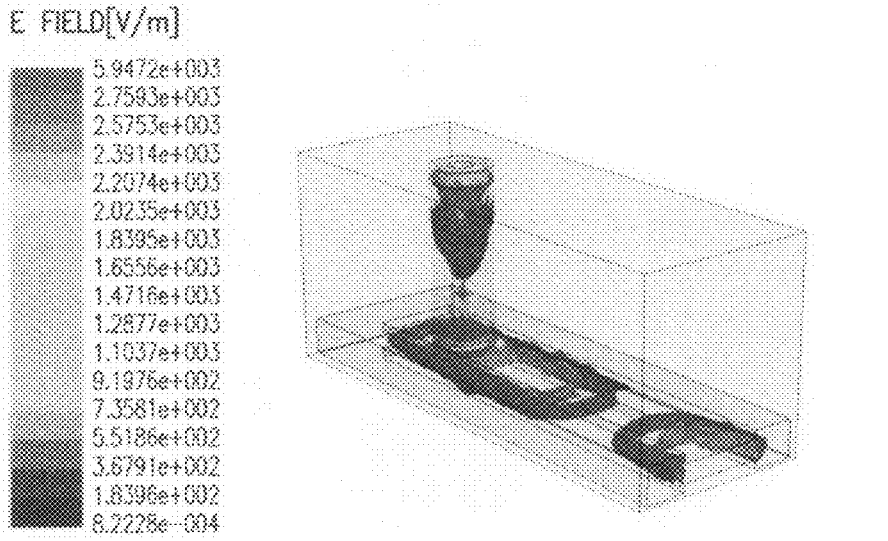
FIG. 6*d* is a computer simulation of a field distribution in the waveguide to coaxial transformer of FIG. 6*a;*

FIGS. 6*a* and 6*b* show a waveguide to coaxial transformer 60 according to one embodiment of this invention. The waveguide to coaxial transformer 60 transforms RF energy in a transverse electric (TE) mode in the waveguide to a coaxial output in a transverse electric and magnetic mode (TEM). Similarly, the waveguide to coaxial transformer 60 can operate in the opposite direction from the coaxial portion to the waveguide. An example operating frequency of 400 MHz has been selected for this embodiment. The waveguide to coaxial transformer 60 comprises a waveguide 61 having a pair of ridges 62 and filled with a high dielectric constant material 63 that is joined at a matching section 64 to a coaxial connection section 65. The coaxial connection 65 preferably extends generally perpendicular from the waveguide 61. The coaxial section 65 in this embodiment comprises two conductors, a cylindrical outside conductor and a concentric inside conductor. The two conductors are separated by a cylindrical insulator. In a preferred embodiment the two conductors can comprise copper. The cylindrical insulator can comprise, for example but not limited to, alumina ceramic, Teflon, or any non-conductive material with a relative permeability greater than one and/or a relative permittivity greater than one. FIG. 6*c* shows a computer simulated transmission response of an alumina matching section and FIG. 6*d* shows a computer simulation of a field distribution in the waveguide to coaxial transformer 60.

Figure 7A:
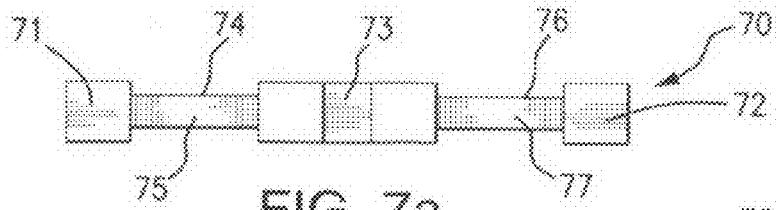
FIG. 7*a* is a side view of a hybrid coupler according to one embodiment of this invention.
Figure 7B:
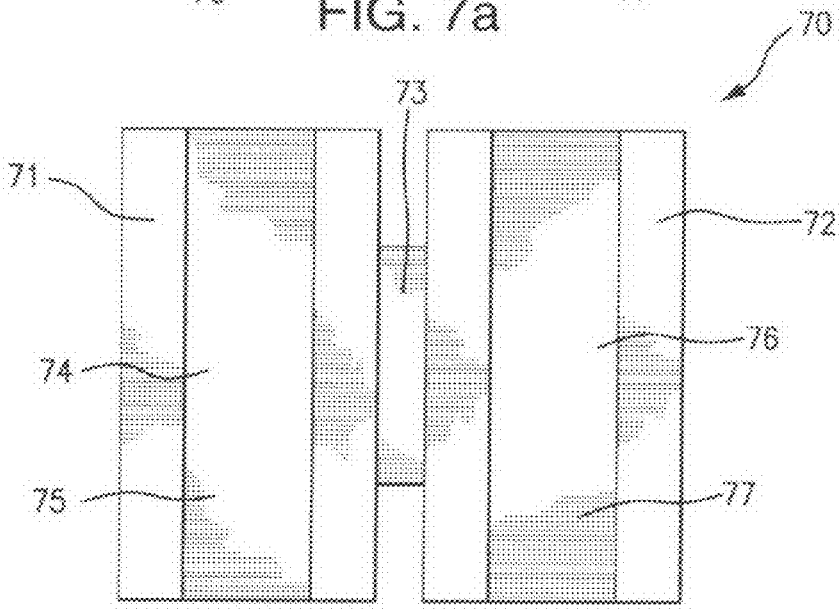
FIG. 7*b* is a top view of the hybrid coupler of FIG. 7*a;*
Figure 7C:
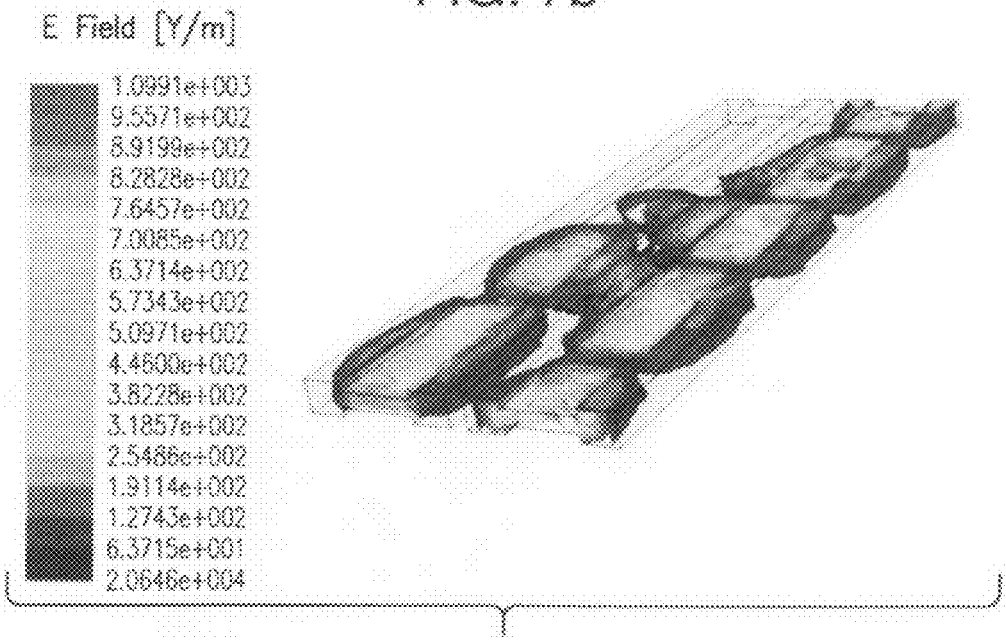
FIG. 7*c* is a computer simulation of a field distribution in the hybrid coupler of FIG. 7*a;*

FIGS. 7*a* and 7*b* show a hybrid coupler 70 according to one embodiment of this invention. An example operating frequency of 400 MHz has been selected for this embodiment. The hybrid coupler 70 comprises a first waveguide section 71 joined to a second waveguide section 72 by a coupling channel 73. The first waveguide section comprises a pair of ridges 74 and is filled with a first non-conductive material 75. The second waveguide section comprises a pair of ridges 76 and is filled with a second non-conductive material 77 which may or may not be the same as first non-conductive material 75. FIG. 7*c* shows a computer simulation of the hybrid coupler 70.

Figure 8A:
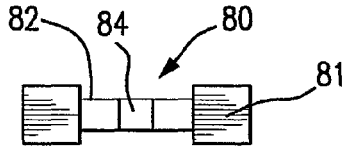
FIG. 8*a* is a side view of a matched load termination according to one embodiment of this invention.
Figure 8B:
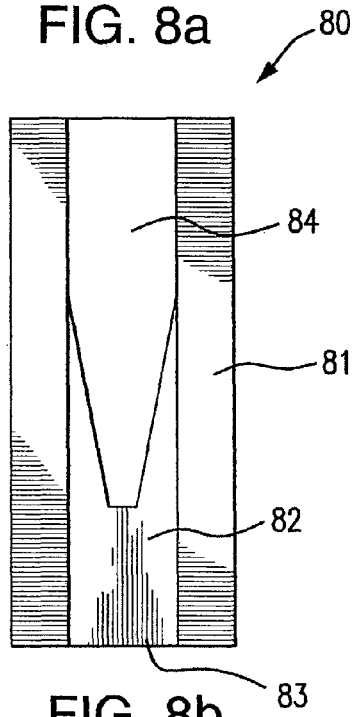
FIG. 8*b* is a top view of the matched load termination of FIG. 8*a;*
Figure 8C:
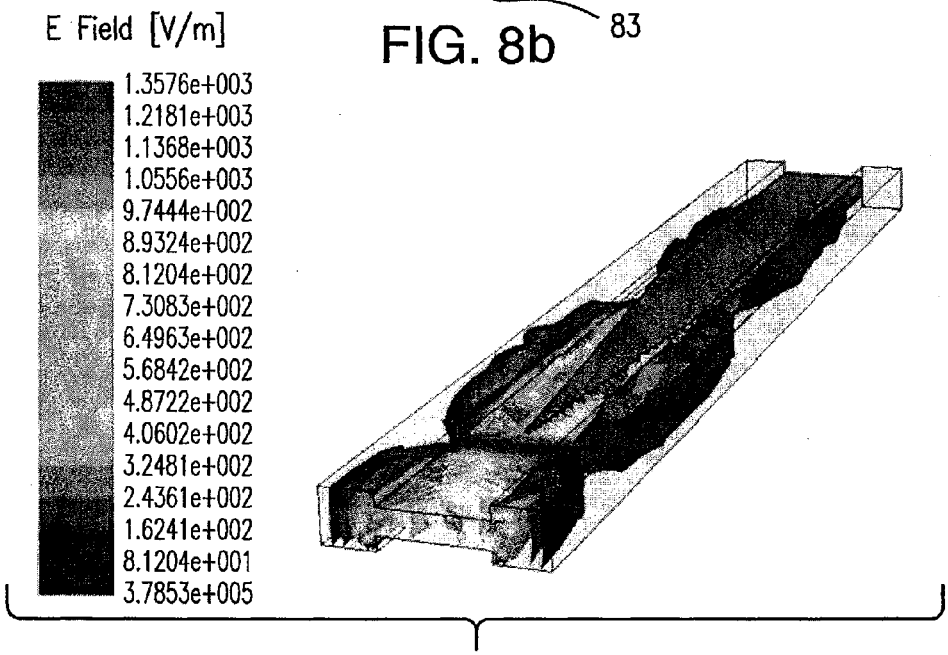
FIG. 8*c* is a computer simulation a field distribution in the matched load termination of FIG. 8*a;*

FIGS. 8*a* and 8*b* show a matched load termination 80 according to one embodiment of this invention. An example operating frequency of 400 MHz has been selected for this embodiment. The matched load termination includes a waveguide 81 having a pair of ridges 82 and is filled with a non-conductive material 83. A RF absorbing material wedge 84 is placed at a terminating edge 85 of the waveguide 81. An RF wave propagates through the RF absorbing material wedge 84 and is converted into heat. FIG. 8*c* shows a computer simulation of a field distribution in the matched load termination 80.

Figure 9A:
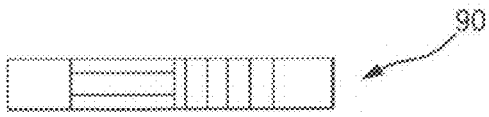
FIG. 9*a* is a side view of a miter bend according to one embodiment of this invention.
Figure 9B:
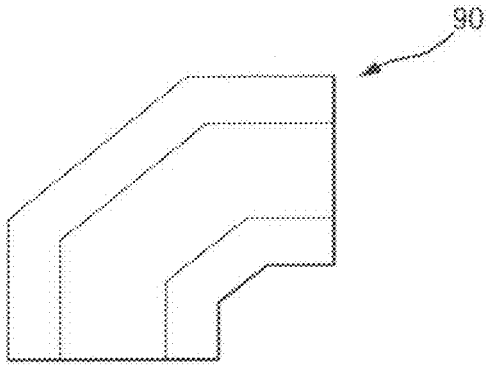
FIG. 9*b* is a top view of the miter bend of FIG. 9*a;*
Figure 9C:
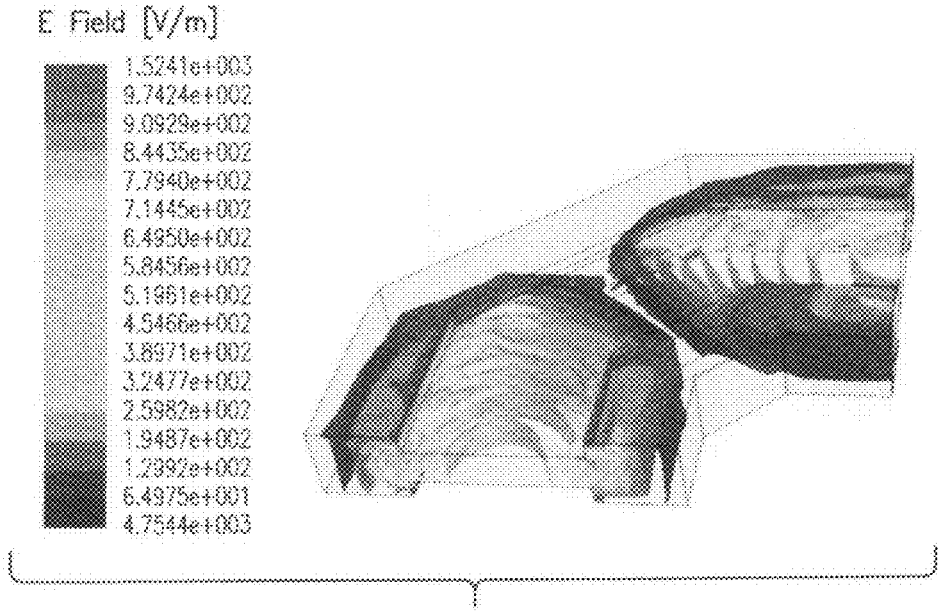
FIG. 9*c* is a computer simulation of a field distribution in the miter bend of FIG. 9*a;*

FIGS. 9*a* and 9*b* show a miter bend 90 according to one embodiment of this invention. An example operating frequency of 400 MHz has been selected for this embodiment. FIG. 9*c* shows a computer simulation of the miter bend 90.

Figure 10A:
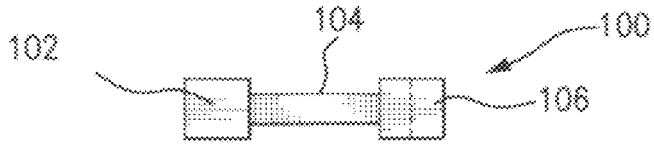
FIG. 10*a* is a side view of a loaded phase shifter according to one embodiment of this invention.
Figure 10B:
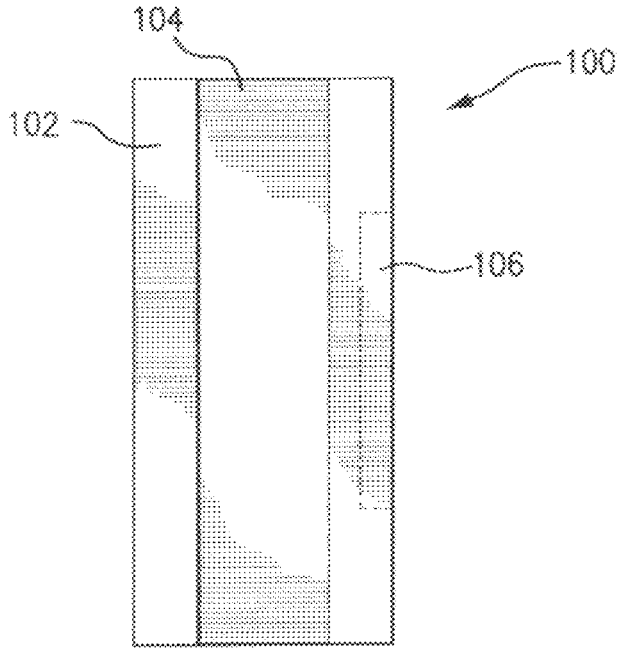
FIG. 10*b* is a top view of the loaded phase shifter of FIG. 10*a;*
Figure 10C:
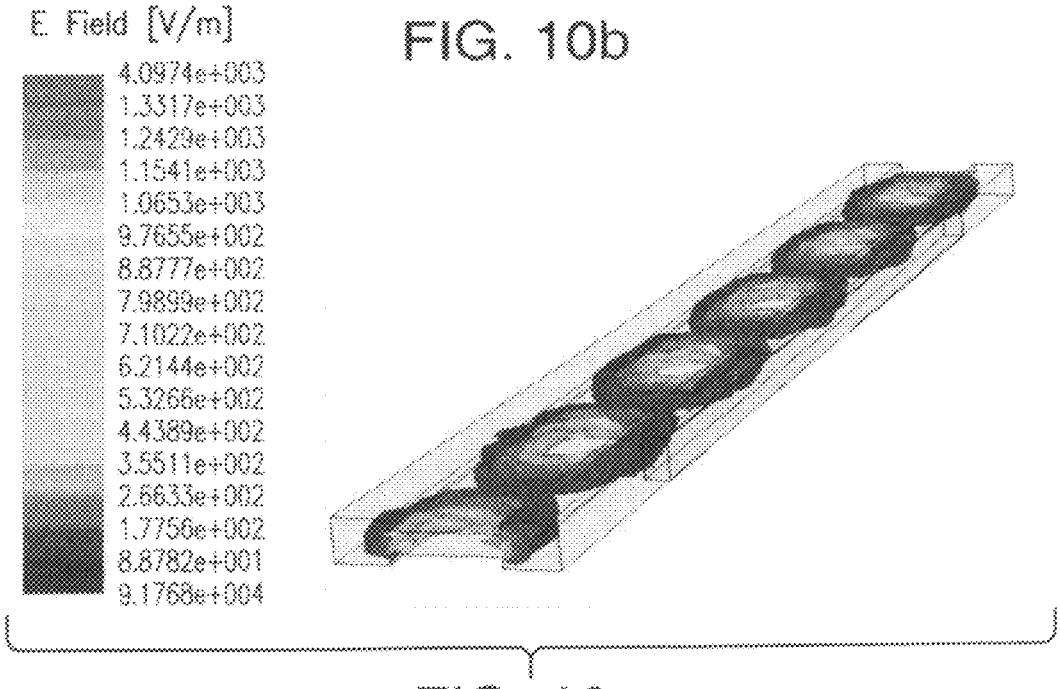
FIG. 10*c* is a computer simulation of a field distribution in the loaded phase shifter of FIG. 10*a;*

FIGS. 10*a* and 10*b* show a Ferrite loaded phase shifter 100 according to one embodiment of this invention. An example operating frequency of 400 MHz has been selected for this embodiment. The Ferrite loaded phase shifter 100 comprises a waveguide 102 with a pair of ridges 104. A Ferrite insert 106 is positioned inside on an edge of the waveguide 102. The Ferrite insert 106 varies the external magnetic bias field which changes a phase of the RF wave propagating through the waveguide 102. In one embodiment, the Ferrite insert 106 can be yttrium iron garnet (YIG). A FIG. 10*c* shows a computer simulation of the Ferrite loaded phase shifter 100. In an alternative embodiment, the Ferrite loaded phase shifter includes a pair of ferrite inserts, each ferrite insert is positioned on opposite sides of the waveguide.

Figure 11:
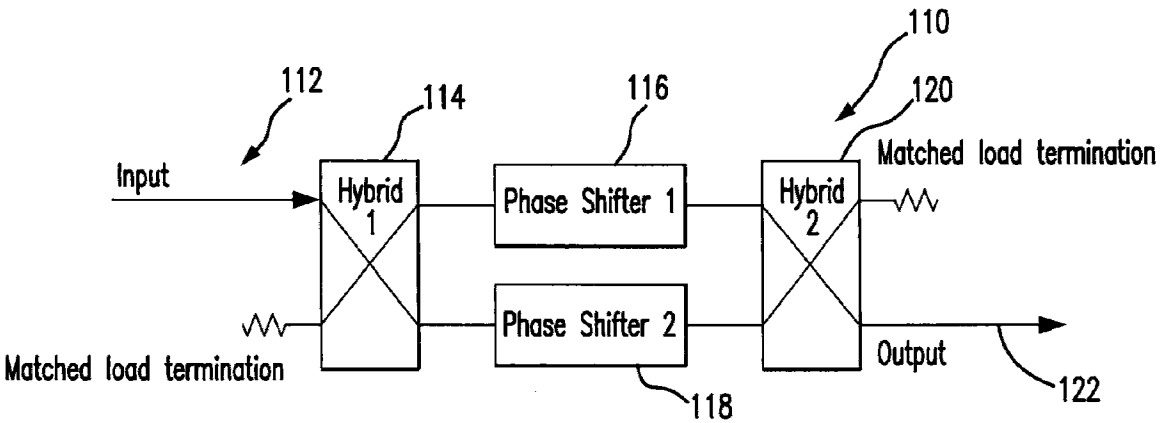
FIG. 11 is a block diagram of a vector modulator system according to one embodiment of this invention.

The proposed components discussed above can be integrated to construct various systems for various applications. For example, FIG. 11 shows a block diagram of a vector modulator system 110 which can be constructed from the components discussed above. The vector modulator system 110 includes an input 112 connected to a first hybrid coupler 114 connected to a pair of phase shifters 116, 118, outputs of the phase shifters 116, 118 connect to a second hybrid coupler 120 connected to an output 122. By adjusting the two phases through the phase shifters, $\phi 1$ and $\phi 2$, the amplitude and the phase of input voltage can be varied at the output voltage as:

$$V_{out}(\phi_1, \phi_2) = V_o \cos\left(\frac{\phi_1 - \phi_2}{2}\right) e^{-j\left(\frac{\phi_1+\phi_2}{2}\right)}$$

Figure 12:
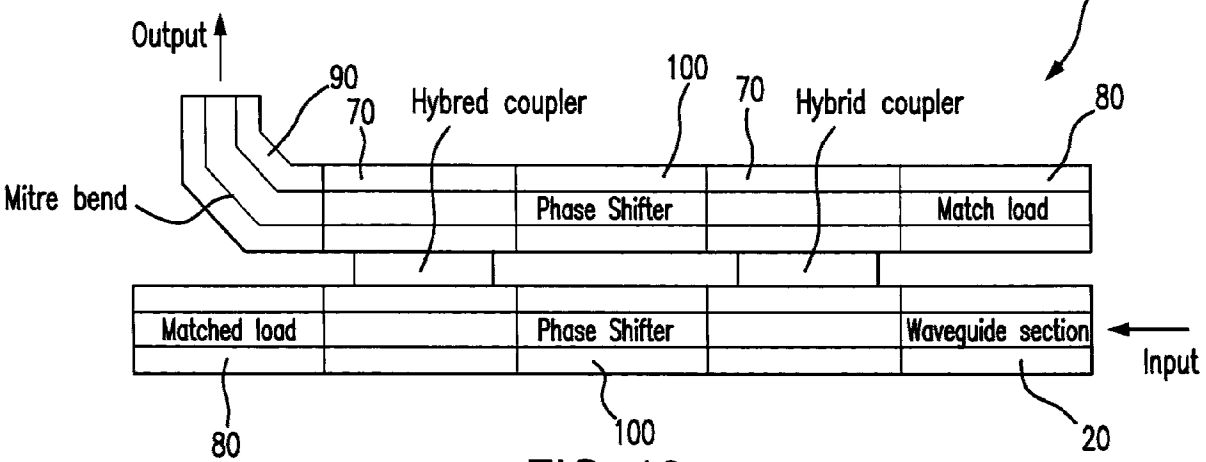
FIG. 12 is the vector modulator system of FIG. 11.

FIG. 12 shows the vector modulator system 110 constructed using the components discussed above.

Thus, the invention provides radio frequency (RF) and microwave components which are smaller than known components by $\cong 1/\sqrt{\epsilon_r \mu_r}$.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

What is claimed is:

1. A waveguide for an operating frequency comprising:
a housing including a broad wall and a narrow wall;
a ridge formed in the broad wall;
a non-conductive material positioned within a volume formed by the broad wall, the narrow wall and the ridge, the non-conductive material having a permeability ($\mu$, $\mu_r$) and a permittivity ($\epsilon$, $\epsilon_r$); and
a coaxial output extending generally perpendicular from the housing at a mating section, wherein the coaxial output comprises copper and alumina.

2. The waveguide of claim 1, wherein the non-conductive material comprises a relative permittivity of 2 to 10,000.

3. The waveguide of claim 1, wherein the non-conductive material is selected from the group consisting of Teflon, alumina, water and ceramic.

4. The waveguide of claim 1, wherein the ridge forms a U-shaped cross-section.

5. The waveguide of claim 1 further comprising:
a second ridge, wherein the ridge and the second ridge form an H-shaped cross-section.

6. The waveguide of claim 1 further comprising:
a coupling channel connected to the housing at the narrow wall, the coupling channel extending to a second waveguide.

7. The waveguide of claim 1 further comprising:
a RF absorbing material wedge positioned at a terminating edge of the housing, wherein an RF wave propagating through the housing is absorbed by the RF absorbing material wedge and converted into heat.

8. The waveguide of claim 1 further comprising:
a Ferrite insert positioned inside the housing on the narrow wall, wherein the Ferrite insert varies an external magnetic bias field which changes a phase of an RF wave propagating through the waveguide.

9. The waveguide of claim 1, wherein the operating frequency is in a range of 100 to 1,000,000 MHz.

10. A waveguide for an operating frequency comprising:
an input comprising an input housing including an input broad wall, an input narrow wall, and an input ridge in a portion of the input broad wall;
an output connected to the input, the output comprising a output housing including an output broad wall, an output narrow wall, and an output ridge in a portion of the output broad wall;
a non-conductive material filling the input and the output, the non-conductive material including a permeability ($\mu$, $\mu_r$) and a permittivity ($\epsilon$, $\epsilon_r$).

11. The waveguide of claim 10 further comprising:
a coaxial output extending generally perpendicular from the output housing at an output mating section.

12. The waveguide of claim 10 further comprising:
a coaxial input extending generally perpendicular from the input housing at an input mating section.

13. The waveguide of claim 10 further comprising:

a hybrid coupler in communication with the input and the output, the hybrid coupler comprising a first housing connected to a coupling channel connected to a second housing;

the first housing including a first housing broad wall, a first housing narrow wall, and a first housing ridge in a portion of the first housing broad wall;

the second housing including a second housing broad wall, a second housing narrow wall, and a second housing ridge in a portion of the second housing broad wall;

the coupling channel connected to the first housing narrow wall and the second housing narrow wall; and the non-conductive material filling the first housing and the second housing.

14. The waveguide of claim 10 further comprising:

a matched load in communication with the input and the output, the matched load including a matched load housing including a matched load broad wall, a matched load narrow wall, a matched load ridge in a portion of the matched ridge broad wall, and a RF absorbing material wedge positioned at a terminating edge of the matched load housing, wherein an RF wave propagating through the matched load is absorbed by the RF absorbing material wedge and converted into heat; and the non-conductive material filling the matched load housing.

15. The waveguide of claim 10 further comprising:

a phase shifter in communication with the input and the output;

the phase shifter including a phase shifter housing including a phase shifter broad wall, a phase shifter narrow wall, a phase shifter ridge in a portion of the phase shifter broad wall; and a Ferrite insert positioned inside the phase shifter housing at the phase shifter narrow wall, wherein the Ferrite insert varies an external magnetic bias field which changes a phase of an RF wave propagating through the waveguide.

16. The waveguide of claim 10, wherein the non-conductive material comprises a relative permittivity of 2 to 10,000.

17. The waveguide of claim 10, wherein the non-conductive material is selected from the group consisting of Teflon, alumina, water and ceramic.

* * * * *